US005400999A

United States Patent [19]

Pavie

[11] Patent Number: 5,400,999

[45] Date of Patent: Mar. 28, 1995

[54] INFLATABLE CONSTRUCTION APPARATUS

[76] Inventor: Henry Pavie, 79, rue de Sevres, F-75006 Paris, France

[21] Appl. No.: 940,867

[22] PCT Filed: Dec. 23, 1991

[86] PCT No.: PCT/FR91/01058

§ 371 Date: Oct. 28, 1992

§ 102(e) Date: Oct. 28, 1992

[87] PCT Pub. No.: WO92/12307

PCT Pub. Date: Jul. 23, 1992

[30] Foreign Application Priority Data

Dec. 30, 1990 [IL] Israel ..... 96825

[51] Int. Cl.[6] ..... E04G 11/04; B28B 7/32

[52] U.S. Cl. ..... 249/27; 52/2.15; 249/65; 249/112; 249/183

[58] Field of Search ..... 249/26, 27, 65, 112, 249/179, 183; 264/31, 314; 52/2.15

[56] References Cited

U.S. PATENT DOCUMENTS

| | | | |
|---|---|---|---|
| 2,324,554 | 7/1943 | Billner | 264/31 |
| 2,388,701 | 11/1945 | Neff | 249/65 |
| 3,139,464 | 6/1964 | Bird et al. | 249/65 |
| 3,257,481 | 6/1966 | Chang | 249/65 |
| 3,643,910 | 2/1972 | Heifetz | 249/65 |
| 3,734,670 | 5/1973 | Stickler, Jr. | 249/65 |
| 3,779,847 | 12/1973 | Turner | 52/2.15 |
| 4,021,972 | 5/1977 | Choate et al. | 52/2.15 |
| 4,568,057 | 2/1986 | Freeman | 249/65 |

FOREIGN PATENT DOCUMENTS

| | | | |
|---|---|---|---|
| 1446813 | 6/1966 | France . | |
| 2293543 | 7/1976 | France . | |
| 2334793 | 7/1977 | France | 52/2.15 |
| 2586055 | 2/1987 | France . | |
| 2810953 | 9/1979 | Germany . | |
| 3149786 | 6/1983 | Germany . | |
| 594955 | 11/1947 | United Kingdom | 249/65 |
| 2118608 | 11/1983 | United Kingdom | 249/65 |
| 1013610 | 4/1983 | U.S.S.R. | 249/65 |
| 1222791 | 4/1986 | U.S.S.R. | 249/65 |

*Primary Examiner*—James P. Mackey
*Attorney, Agent, or Firm*—Browdy and Neimark

[57] ABSTRACT

Inflatable formwork mould for supporting one or more applications of hardening building materials, applied while still in a plastic state. The formwork mould is characterized in that at least two of its sides (20) consist of elongate, cross-shaped, modular base element (10), each having a longitudinal axis parallel to the one adjacent thereto; each base element (10) is made to conform to the shape of a U-shaped groove (12), and is produced from an airtight, flexible material impermeable to water and assembled by welding, stitching, bonding and the like. A link system (26) joins a number of base elements constituting one side to a corresponding number of base elements opposite forming the opposite side (20). The links (26) of a predefined length, preserve the entire geometrical relationship between the two opposing sides (20) of the inflatable formwork mould. An external envelope optionally made from an extensible material produces a smooth, plane or curved moulding surface. The invention adapts the technique of inflatable formwork to all kinds of architectural forms.

12 Claims, 6 Drawing Sheets

INFLATABLE CONSTRUCTION APPARATUS

BACKGROUND OF THE INVENTION

This invention relates generally to building construction, and more particularly to construction utilizing a reusable, inflatable form upon which there is applied a cementitious material to form a structure which may be a building or a part thereof.

In the past building construction, utilizing inflatable forms over which a cementitious material is applied, had predominantly been of circular cross section, domed or of a generally spherical configurations. These limitations were imposed partially to take advantage of the structural integrity of the shapes, and also because of the ease of construction of the inflatable form and the resultant structure. Variations in dimensional integrity were offset by the lowered construction costs; however, the avoidance of conventional construction building designs was dictated by the unavailability of inflatable forms which could maintain straight sided walls, where desired. When inflation pressures were required to support a heavy load of the cementitious material, the wall and/or ceiling areas would bow. For multistoried buildings domed construction inhibited the effectiveness of a straight structure to define both the ceiling of the lower story and the floor of the upper story.

Public acceptance of igloo type structures, curved outer walls of a building and other shapes that diverge from the conventional square or rectangular configurations has been dismal. However, there is a dire need for the economical, quick, efficient, structurally sound type of construction afforded by structures using inflatable forms in order to accomodate the world-wide population shifts and the attendant increased housing and industrial construction requirements. None of the prior art proposals have enabled the production of conventionally shaped buildings with the inflatable form technique, because of the failure of the industry to produce low cost forms of conventionally acceptable design with structural and dimensional integrity.

SUMMARY OF THE INVENTION

The invention comprises a novel, inflatable form that maintains dimensional integrity in a construction milieu to allow the production of buildings and/or modules having straight, substantially orthogonally related surfaces, thereby overcoming the deficiencies of the prior art.

Accordingly, it is a primary object of this invention to produce an inflatable form for a building of cementitious material applied over the form, the form having straight sides, where desired, that maintain their dimensional stability under pressures required to support the said material.

It is another object of this invention to provide a novel, inflatable construction form that utilizes a modular construction for the form, while the form itself can form a module of a structure to enable versatility in building design.

It is still another object of this invention to provide an inflatable, reuseable form for building construction that allows for the preplacement of reinforcement, electricity, plumbing and communication equipment, etc. within the walls of the structure to provide for economical access for the installation of the devices to be attached thereto.

It is a further object of this invention to provide an inflatable, reusable form for modular construction of a building that enables the joinder of separate modules to form separate rooms using doors to communicate one room with another wherein the door frames or frames of other communicating openings can be integrated into the resultant structure during the application of the cementitious material that forms the walls of the rooms.

It is a still further object of this invention to provide an inflatable, reusable module for application of a cementitious material thereto to provide the walls and ceiling of the resultant structure, wherein window and door frames can be included in the construction by their application to the form prior to the application of said cementitious material.

Another object of this invention involves the provision of a novel, inflatable modular form for building construction utilizing a cementitious material applied to the module for forming the walls and ceiling of the resultant structure, the module utilizing internal strapping to maintain the dimensional integrity of the module and resulting structure.

Still another object of this invention involves a modular construction method and apparatus which enables the use of structural members at the periphery to assure right angled corners, the members being either fixed in or removable from the resultant structure.

An additional object of this invention involves the use of a number of modules of different shapes capable of being secured one to another to produce a composite building module.

A still additional object of this invention involves the provision of a building module capable of having a cementitious material applied thereto, comprising a three dimensional, hollow, structure of flexible material adapted to be collapsed and inflated, the shape of said module being maintained by internal means located and connected between internal surfaces of said structure and being of lengths calculated to maintain the geometric relationship of a desired shape, thereby preventing undesired distortion of the module when it is inflated.

A further object of this invention involves providing an inflatable, six walled, parallelepiped building module comprising, a series of elongated, generally cruciform shaped members, each having a longitudinal axis substantially parallel with the others and lying in the same plane, each of said members being constrained to form a generally U-shaped channel of a supple material, impervious to air and water; means for joining adjacent sides of said channels together, to form a wall of said parallelepiped having four sides and edges, each of said walls of said parallelepiped being substantially identical to the wall opposite; means for sealing adjacent wall edges forming said parallelepiped together for rendering said parallelepiped air and watertight; and, means integral with said sides of said channels of one wall of a predetermined length and connecting with the channel sides opposite for maintaining the dimensional integrity of the parallelepiped when it is under pressure.

A still further object of this invention involves providing a generally water and airtight, six sided, closed building module comprising, top, bottom and four side walls to form a closed module, each of said walls being a parallelogram formed of a series of elongated, coplanar, generally U-shaped channels adjacent one another, walls opposite one another being substantially identical; means for sealing each of said channels to its adjacent channels; means for sealing the sides of said parallelogram walls to walls adjacent thereto; and, means for maintaining a predetermined distance between opposite walls of said module.

Another object of this invention is to produce an inflatable form for building construction that is easy and economical to produce of conventional, currently available materials that lend themselves to standard mass production manufacturing techniques.

These and other advantages, features and objects of this invention will become more apparent from the following description taken in connection with the illustrative embodiments in the accompanying drawings.

BRIEF DESCRIPTION OF THE DRAWINGS

An inflatable form for buildings of a cementitious material in accordance with the present invention will be described infra, with reference to the accompanying drawings, which are not drawn to scale, and wherein like numerals denote like parts, of which

DESCRIPTION OF THE PREFERRED EMBODIMENT

Figure 1:
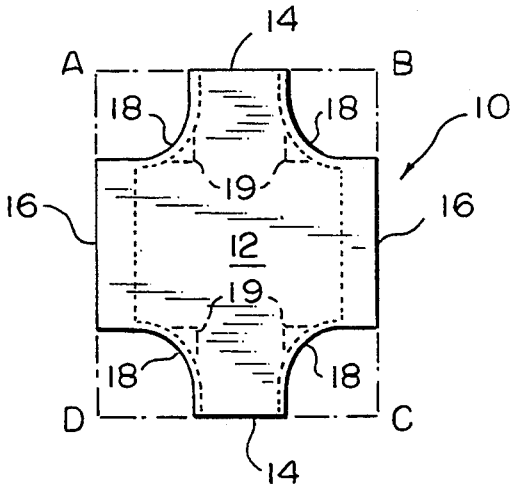
FIG. 1 is a plan view of the material used as a modular unit for construction of a building module form.
Figure 2:
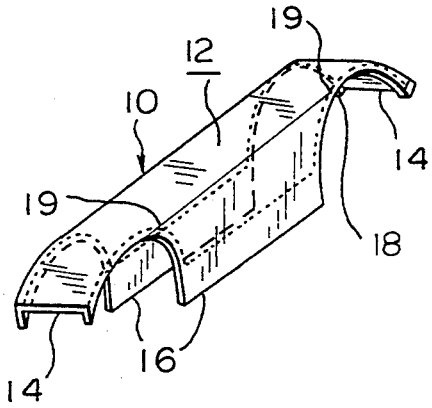
FIG. 2 is a schematic pictorial representation of the modular unit of FIG. 1 shown in the shape it assumes in the building module.

Referring to FIGS. 1 and 2, there is shown a modular unit 10 of a building module comprising a rectangular piece of material 12 with a perimeter A,B,C,D,A, which has material at each corner of the rectangle cut and removed to form the generally cruciform shape as defined by the solid lines. The material 12 now has two end flaps 14 and a pair of side flaps 16 with a quarter round fillet 18 being provided to change the direction of curvature to allow for the downward slope of end flaps 14 at the intersection 19 of each end flap 14 with its adjacent side flaps 16.

The material 12 should be supple and impervious to air and water as well as having ultra violet ray resistance. Stretch, tear and abrasion resistance are also desirable traits as is the ability of the material to be joined to others by standard techniques, such as by utilizing high frequency equipment, conventional thermal means, sewing or chemical adhesive gluing.

Also shown in FIG. 1 is a dotted line indicating the joinder line for assembling other, substantially duplicate modular units 10 by one of the standard methods. FIG. 2 illustrates the modular unit in the configuration it normally assumes in the construction of a building module.

Figure 3:
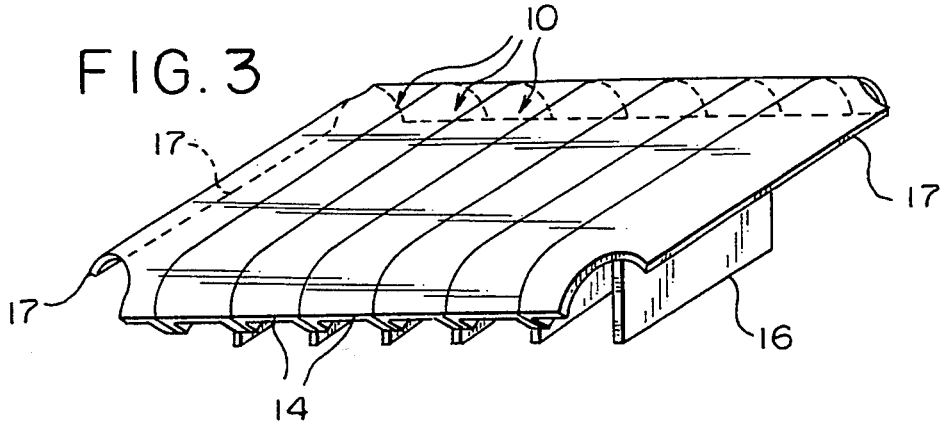
FIG. 3 is a schematic representation of multiple units connected for forming a wall of a modular building form.
Figure 4:
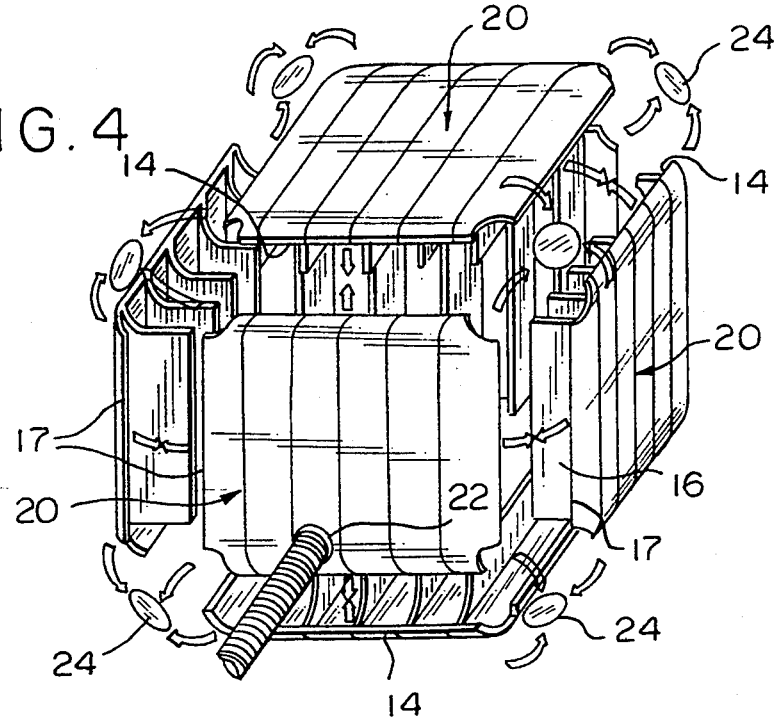
FIG. 4 is an exploded view of a building module form for a parallelepiped structure.

FIG. 3 illustrates schematically a series of modular units 10 joined along the dotted lines illustrated in the previously described FIGS. 1 and 2. The series of modular units 10 could be used to form one wall or side 20 of a parallelepiped as is illustrated in FIG. 4. The fluted surface of the assembled modular units 10 might not conform to the desired motif of a wall formed over the surface. Accordingly, to achieve a smooth, straight surface a sheet of material, which could be similar to 12 of the modular unit, would be applied over the assembly of FIG. 3, as will be described later relative to FIGS. 9*a* and 9*b*.

In FIG. 4 an inlet pipe or hose 22 to deliver pressurized air is provided through one of the walls 20 in a conventional manner. Each wall 20 is connected to its adjacent walls by securing and sealing together the adjacent end flaps 14 and also the wall side flaps 17 to form the corners. End flaps 14 adjacent a side flap 17 would be joined thereto. The wall side flaps 17 at the wall edges may be cut and reformed, as shown at 17 on FIG. 3, to avoid an excess of material, to form the corners of the parallelepiped. The arrows illustrate the wall portions and direction that they are to be moved to be joined. Spherical pieces of material 24 at the upper and lower corners at the joinder point of three walls are provided to seal the like shapes openings in the form so that it can be inflated.

Figure 5:
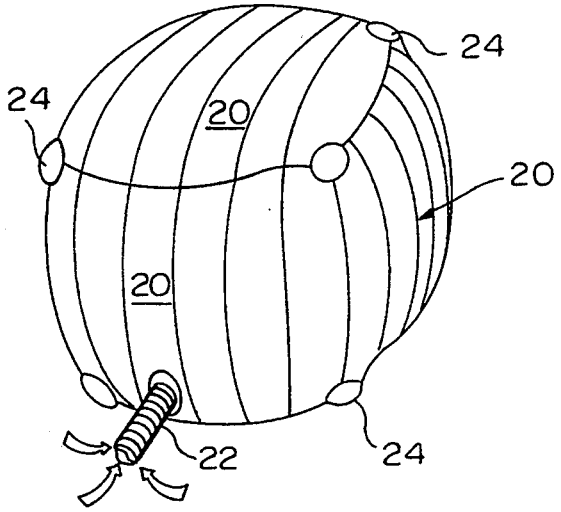
FIG. 5 PRIOR ART
FIG. 5 is an axonometric view of a modular building form of the prior art when inflated to support a cementitious material to be applied thereto.

The axonometric view of FIG. 5 illustrates the problem of bowing of the walls of the parallelepiped when the form is inflated with sufficient pressure to support the cementitious material to be applied to the form. The dimensional integrity of the resultant structure is lost and the curvature would not be architecturally acceptable to the consumer. This invention rectifies the problem and provides standard shaped structures with orthogonally related walls, while allowing for curved and domed arrangements or portions thereof, only where desired.

Figure 6:
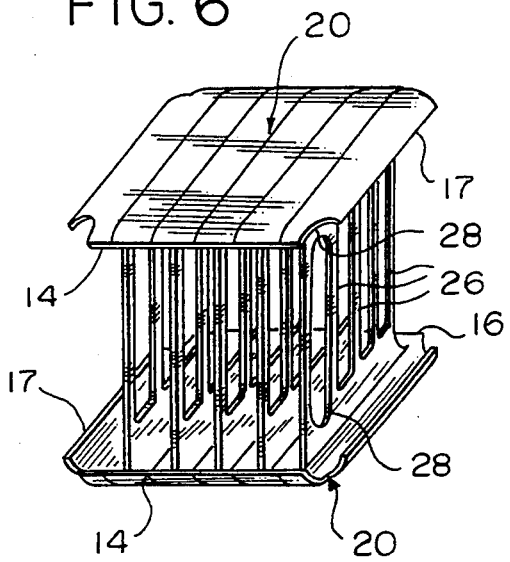
FIG. 6 is an illustration of a method and apparatus for obtaining dimensional stability according to the present invention.

FIG. 6 illustrates a portion of a system for keeping the dimensional integrity of the module. In this Figure the side flaps 16, pairs of which have been joined together as illustrated in FIG. 3, have continuations from top to bottom opposed walls forming straps 26 for maintaining dimensional stability of the opposed walls 20, as shown. This would eliminate bowing when the surfaces 20 are under pressure. The strapping 26 could be separate strips of material sealed to opposed side flaps 16 or formed as part of extensions of some of all of the side flaps and joined to the opposite flap or an extension thereof. Although the straps 26 are shown predominantly emanating from straight edged side flaps, the flaps could preferably be fluted, as shown at 28, so that arcuate portions between the straps would avoid concentration of stress. It should be noted that the strap system and seals would be under tension, to take advantage of the maximum strength of the sealing or bonding of the materials.

Figure 7:
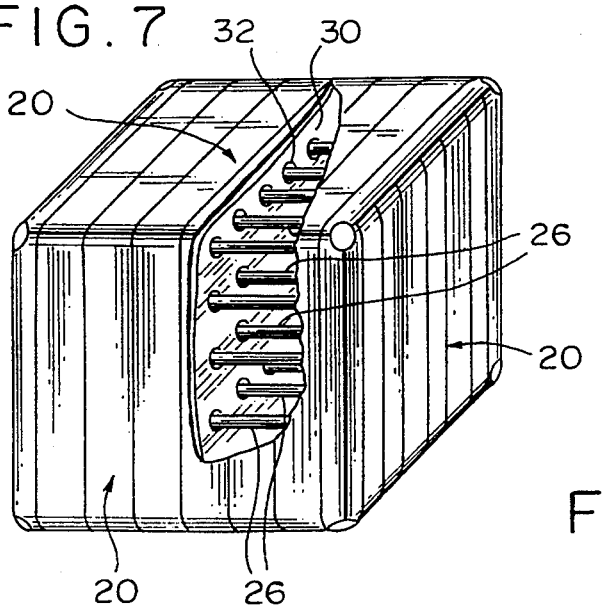
FIGS. 7 and 8 are isometric views, partly in section, of alternative modes for obtaining dimensional stability.

FIG. 7 illustrates by way of example sheets 30 instead of separate straps. With the building module in the position illustrated, this is, but does not have to be, vertically oriented. The sheets or side flap extensions 30 have holes 32 therethrough to accommodate straps 26, orthogonally oriented with respect to the sheets 30 and the opposed wall 20 when the parallelepiped module is inflated. Thus, the sheets 30 and straps 26 have dimensionally stabilized opposite walls 20 dimensionally.

Figure 8:
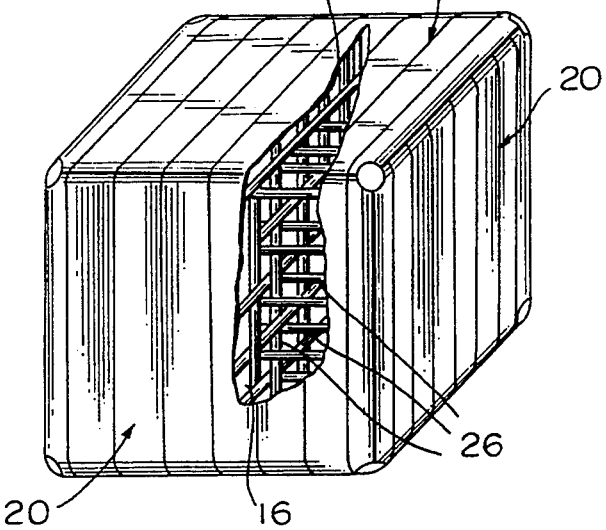

FIG. 8 is a view, partly in section, of an alternative embodiment utilizing straps 26 from each wall 20 to its opposite wall to accomplish the same effect as the embodiment of FIG. 7 in that the building module is dimensionally stabilized in all directions in which bowing may be expected.

Figure 9A:
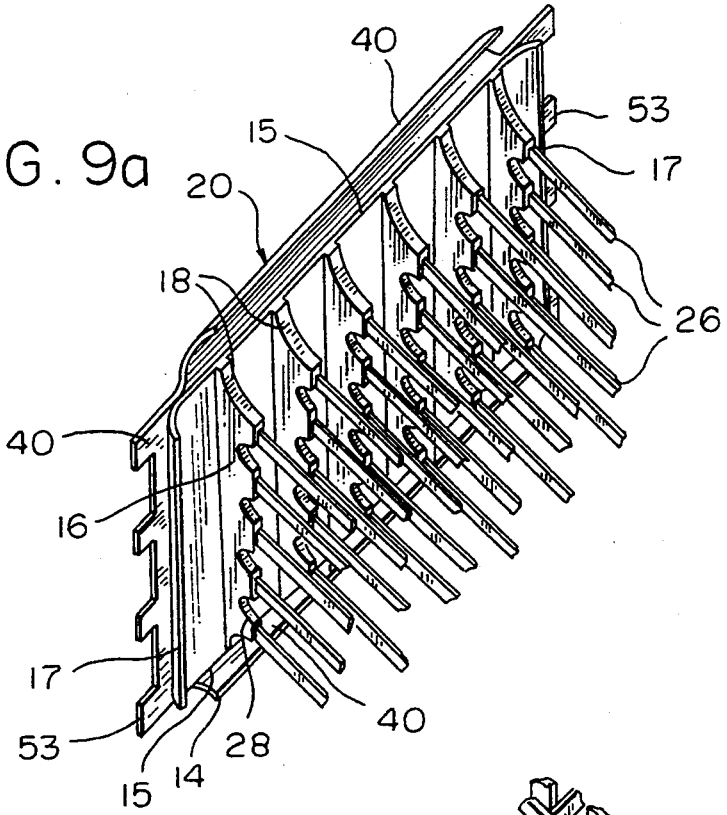
FIG. 9*a* is an isometric view of the inside of a wall section illustrating a smooth, straight, outer surface for cementitious material application; and apparatus at the periphery to assure right angled corners.

Since the embodiments thus far described show straight sided walls and ceilings, it might be considered desirable to avoid the fluting caused by the rounded portions of the modular units 10, as illustrated in FIGS. 2 and 3. One way of achieving this is to provide an unstretchable sheet 40, as illustrated in FIG. 9*a*. A series of modular units 10 would be assembled as in FIG. 3; however, the modular units 10 would be modified to eliminate that part of the end flaps 14, beyond the arcuate portions 18, having straight sides parallel with the side flap edges. The side of the sheet 40 would make up for the shortened portion by extending the appropriate distance beyond the new edge 15 of the end flaps to provide the edges to be joined to form the parallelepiped. Likewise, the wall side flaps 17 could be adjusted to allow sheet 40 to extend beyond to the appropriate length to provide for the sealing at the corners. The sealing of the spherical caps 24 to the matching openings, as illustrated in FIG. 4, would complete the external sealing procedure. Internally, the wall 20 would be sealed to sheet 40 along the line of tangency of sheet 40 and the modular unit 10 ending wall 20, and along the new edges 15 of the shortened end flaps 14. The result is now a channel with a substantially flat bottom portion between the side flaps 16. The cover or sheet 40 would now provide a smooth, flat surface to which the cementitious material is applied.

Figure 9B:
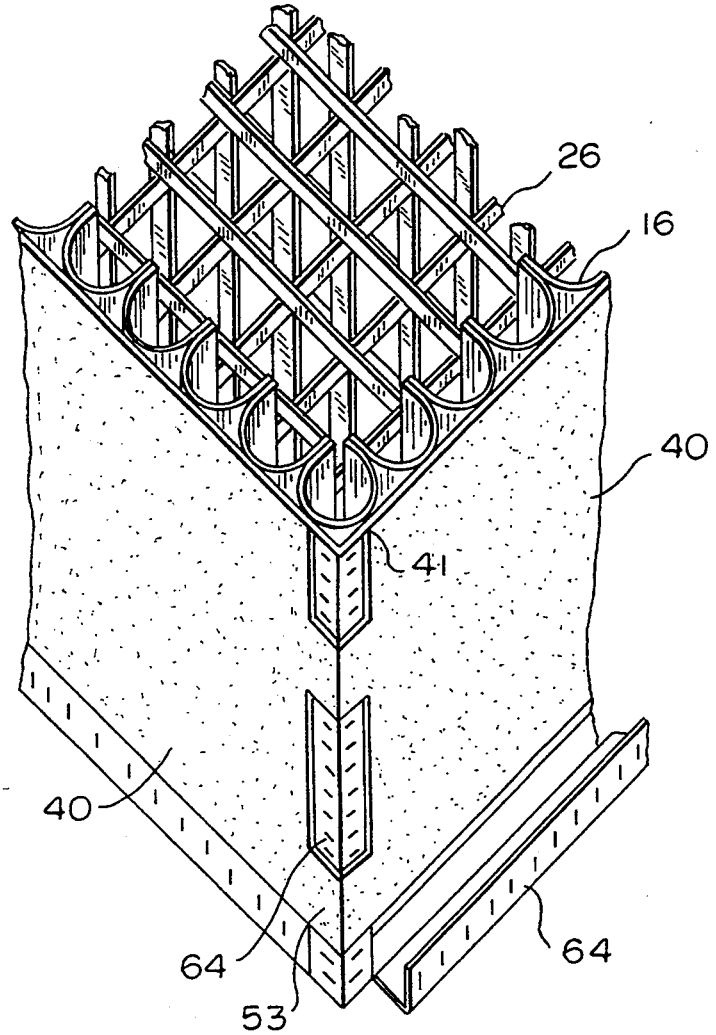
FIG. 9*b* is an axonometric view of a portion of a building module utilizing a stretchable cover. The module having apparatus at the periphery to assure right angled corners.

In FIG. 9*b* there is provided a system and apparatus for not only providing a flat, non-fluted surface, for cementitious material application, but also apparatus for avoiding the rounds at all of the corners. The right angle elements 64 are used at the base (one of which is shown in its operative position and the other in a position of readiness to be slid onto a foundation or slab end against the building module) and at the vertical corners. Elements 64 may be of metal or plastic and either can be arranged to be a permanent part of the structure or can be removed for reuse. Instead of being right angled pieces, they could be any type of profile. In this instance the sheet 40 is made of a stretchable material, such as Tricot, thereby allowing the channels to take their normal, rounded shape. In both of FIGS. 9*a* and 9*b* the edge for joinder of two adjacent sheets 40 at a corner is notched to provide a sleeve 53 with openings, when desired, to enable access to the angle member 64. In FIG. 9*b* the assembly of module units 10 are sealed to the cover or sheet 40 along a line of tangency of sheet 40 with the corner channel portions at 41.

Figure 10:
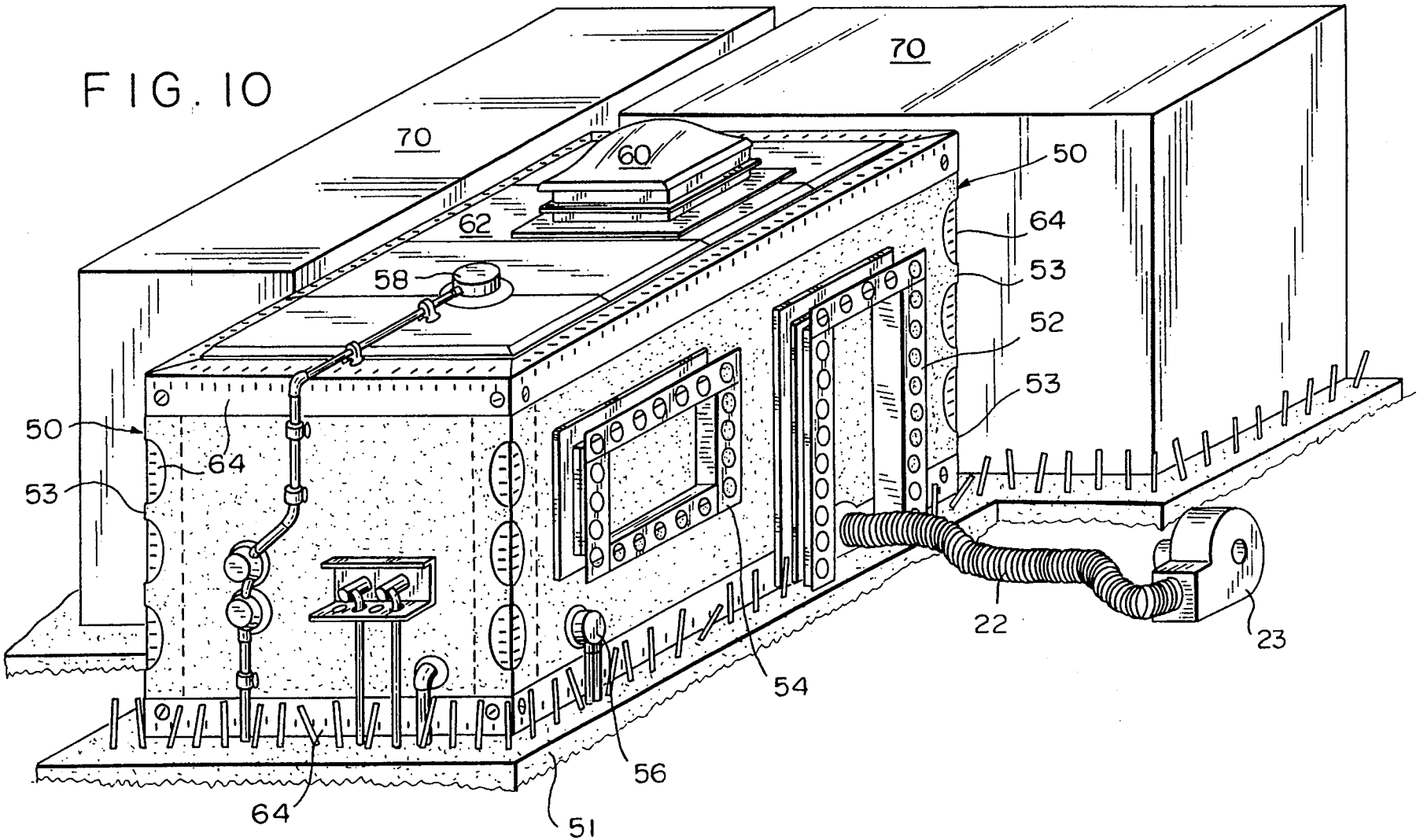
FIGS. 10 and 11 are isometric representations of a parallelepiped building module form readied for cementitious material application and as a completed building of multiple modules, respectively.

Referring to FIG. 10, there is shown a room module 50 which may be used as a single structure or may be combined with other modules 70 to be interconnected to form a unitary structure of many rooms or assembled vertically for other building stories. After the room module 50 is attached in a conventional manner to a previously prepared base or foundation 51, it is inflated by known, conventional means, such as inlet hose 22 connected to the module 50 and a source of pressurized air 23 to at least partially inflate the module. Partial inflation would allow for easier installation of some panels.

The module would then be ready for accommodating doors, windows, electric and plumbing accessories, air conditioning ducts, etc. As shown, there is a door frame 52, window frame 54, electric outlet 56, ceiling light 58, a skylight 60, and other connections for utilities which are common for the purposes for which the structure is built. The roof of the structure, to which a ceiling light 58 and skylight 60 are to be made integral may include a series of ceiling panels 62, which may have acoustic deadening properties, to which the accessories are fixed.

Since there are gently rounded corners naturally occurring at the juncture of walls and ceiling of the building form module, corner angle beading or molding 64 of either plastic or metal is provided at both the top and bottom perimeters of the wall and may also be used at the internal or external corners within a room to be formed by the building module. Where the items 64 are not needed or required in the building structure, they could be made removable for reuse. For example, vertical corner angles are shown, inserted in a sleeve 53 formed as part of the building module, When the module is collapsed, the corner angles are laid on the diagonal of the parallelogram of the base or ceiling for storing and porterage to the building site for inflation. The bottom angle member may be a part of the base or slab on which the collapsed building module is to be erected. As shown, the angle members are perforated and, wire or clips may be used in conjunction therewith to place in a desired position the items to be included within or on the wall to be formed. If desired, wall paneling or gypsum board or any texturizing material may be utilized to provide an interior finished wall within the completed structure.

The accessories and elements that are illustrated may be applied directly to the module by means of removable adhesive. Note that closets, kitchen cabinets, shower stalls, etc. may be provided with building modules made to size and attached to the room or building sized building modules to allow for built-in features where the external shape added on to the basic straight wall structure would be architecturally and esthetically pleasing.

Figure 11:
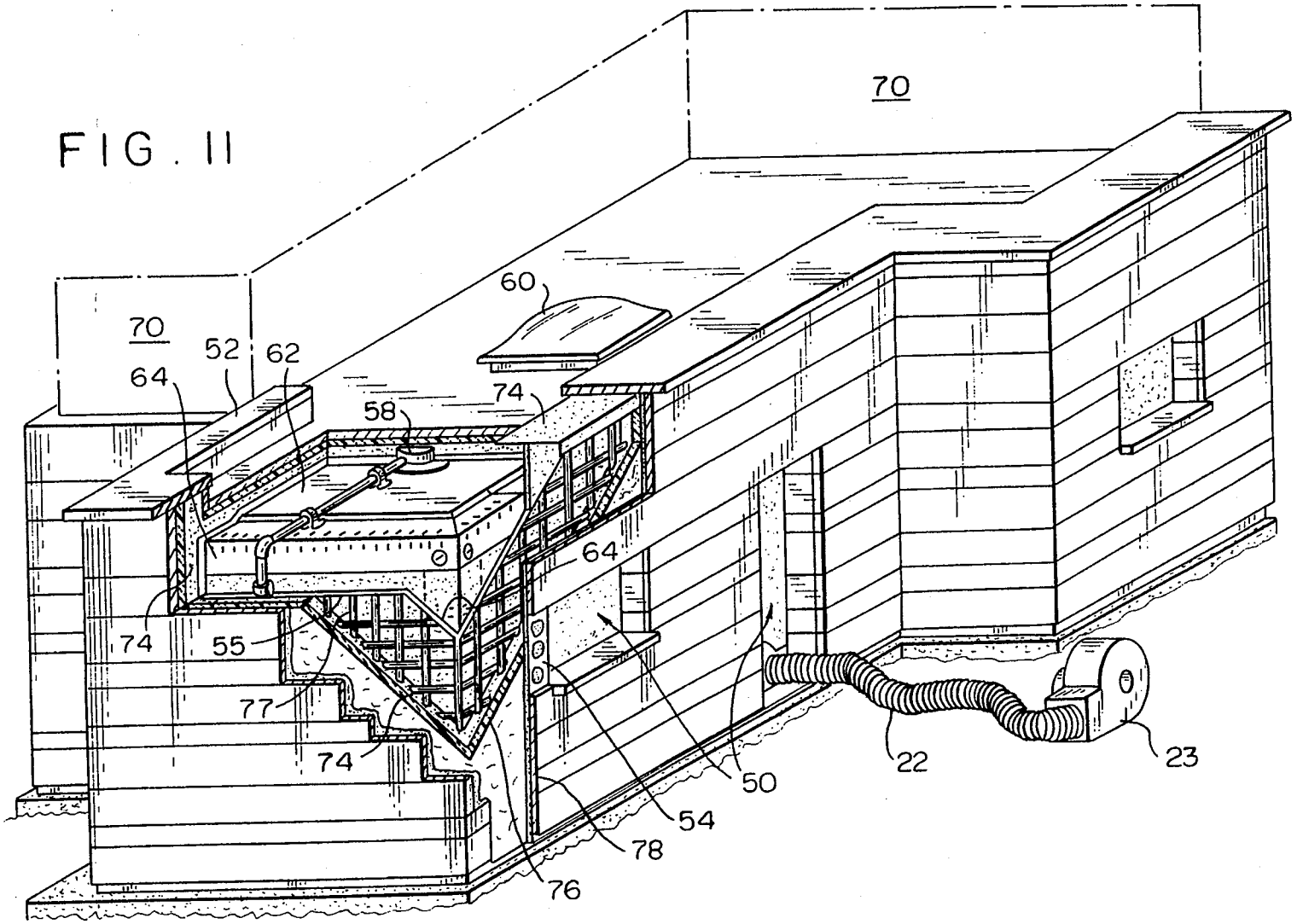

FIG. 11 illustrates the building module with the various stages for completing the building represented. For example, the build up of the exterior walls illustrates the possibility of using gypsum board 66, reinforcement rods or wire 77, cementitious material 74, insulation 76 (may be foamed in place) and a building finish 78. Additional storeys may be added as schematically illustrated in phantom.

Figure 12:
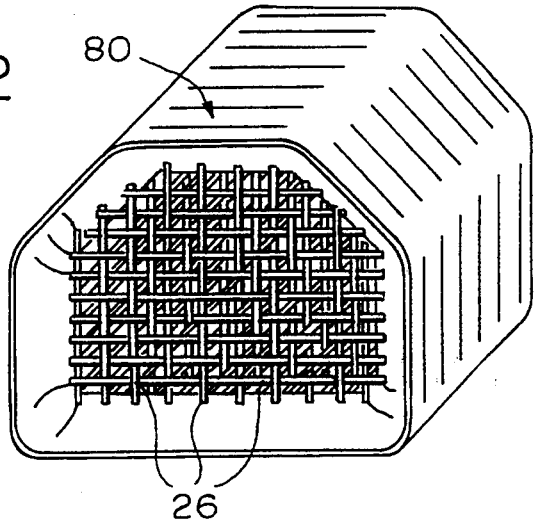
FIGS. 12 through 14 illustrate the possibilities of producing other shaped structures using the concepts of this invention.
Figure 13:
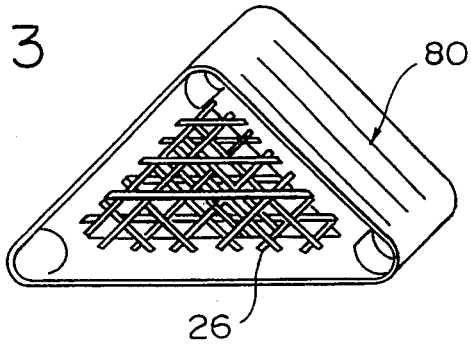
Figure 14:
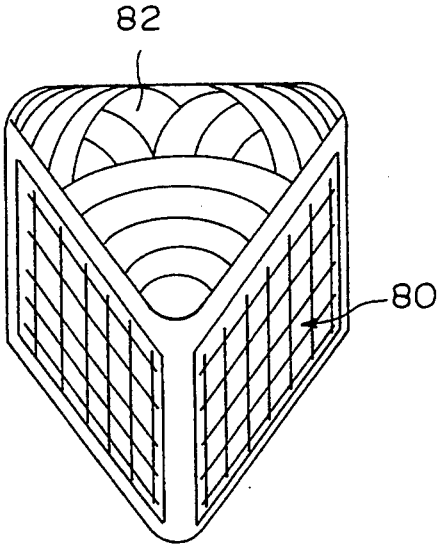

FIGS. 12 through 14 illustrate different shaped modules 80 utilizing the concepts of this invention. FIGS. 12 and 13 illustrate structures having a modified gambrel and a peaked roof, respectively, while FIG. 14 portrays a generally triangular floor plan. With structures that deviate from rectangular or square floor plans there are two preferred modes of attack. One is to produce an unitary module where, for the examples shown in FIGS. 12 and 13, the longitudinal straps would all be of the same length, while the vertical strapping would vary in accordance with the location of the straps to provide the straight slopes of the roofs. With regard to FIG. 14 a curved or toric roof formed by incurvated base modules 82 would have the vertically oriented straps vary in length to constrain the roof material of the module to conform to the desired curvature. If the end 82 of the module is to be curved or bowed, the horizontal strapping would also vary to obtain the desired curvature.

An alternative to the above described, separate, unitary modules of FIGS. 12 through 14 contemplated by this invention is to separate the composite modules into, for example, modules of parallelepipeds that could be joined together to form polygonal structures of different sizes and modules that are triangular, domed, pyramidal, curved, or unitary combinations, where economy dictates, etc., that could be secured to the main module to produce a resultant composite module for any of the various building shapes desired.

OPERATION

The building module of this invention is brought in a collapsed condition to the building site, which has been prepared with a foundation or slab with appropriate means, which do not form a part of this invention, for fastening the building module thereto. A source of pressurized air is applied to the interior of the building module and the pressure is adjusted to acommodate the weight of the requisite amount of cementitious material to be applied to the module. Additional building modules may be applied to the same slab and module for other features, such as angled roofs, curved walls or roofs, closets, showers, cabinets, etc., would also be secured to the base and/or building module, where required. Frames for opeings between connecting modules are placed to be between and in contact with each of the adjacent modules, and utility structures, may be adhesively taped or otherwise releasably applied to the appropriate building modules as well as other reinforcing means or corner angle members to become integrated into the structure. At this point a cementitious material, commercially available, is applied to complete the external walls and roof of one story buildings or the ceiling of the first story and the floor of the second, etc, When two building modules form interconnecting rooms with a common wall, the common wall is usually formed between the two building modules after application of the cementitious material forming the exterior of the structure. A bridging member may be used to provide a base for the cementitious material at the space at the juncture of the modules. The resultant structure would conform to conventional architectural designs and would lend itself to the inclusion of parapets, domed sections and other modernistic shapes not easily fabricated by construction techniques other than by the use of inflatable building modules. The versatility of the concept of this invention also includes polygonal floor plans and polyhedron structures.

The utilization of the building modules of this invention enable the economical, architecturally handsome, speedy construction of structures not capable previously of being accomplished.

Although the invention has been illustrated in the accompanying drawings and described in the foregoing specification in terms of preferred embodiments, the invention is not limited thereto. It will be apparent to those skilled in this art that certain changes, modifications, and substitutions can be made without departing from the spirit and scope of the appended claims.

What is claimed is:

1. A modular base element useable to form an envelope of a inflatable and deflatable device which is fluid-tight and, when inflated, is employed as a reusable formwork support for building construction, said modular base element (10) comprising:

an elongated sheet or membrane (12) being made from a flexible fluid-tight material which is resistant to ultraviolet radiation, abrasion and traction and can be welded, vulcanized, adhered or sewed;

said sheet or membrane (12) having four scallops (18), respectively located at corners of said sheet or membrane (12)

said scallops being mutally symmetrical with respect to an axis of longitudinal symmetry and an axis of transverse symmetry of said sheet or membrane;

each scallop of said scallops contained respectively within each of four quarters of said sheet or membrane as defined by the intersection of said axis of longitudinal symmetry and said axis of transverse symmetry of said sheet or membrane;

a shape of each scallop being a hyperbola whose two asymtotes would respectively be parallel to each of said axis of longitudinal symmetry and said axis of transverse symmetry of said sheet or membrane;

wherein said modular base element is formed as a U-shaped rib with a semicylindrical surface whose convexity is turned toward an outside of said inflatable and deflatable device when assembled, with two flat extensions (16) tangent to the semicylindrical surface along two longitudinal edges thereof, each of said two flat extensions (16) being composed of a section of said sheet or membrane included between a line of tangence with respect to said semicylindrical surface, a first part of a contour of two scallops of said four scallops (18) between which said section is formed, and a long side of the sheet or membrane.

2. The modular base element according to claim 1, wherein said modular base element (10) is used to make a modular portion (20) of the envelope of the inflatable and deflatable device, said modular portion (20) comprising a plurality of modular base elements each of which is made from one said modular base element (10), each said base element (10) joined together along the line of tangence of the abutting base elements and further along a second part of said contour of said two scallops (18) extending away from said flat extensions (16), a short residual surface of each end of the U-shaped rib located between two scallops (18) being folded down to permit end to end engagement of a short side (14) of the sheet or membrane (12) to create two opposite parallel borders of said modular portion, another two borders completing a perimeter of said modular portion composed of two long sides of and continguous scallops of two exterior base elements, said perimeter forming a rectangular surface having a scallop (18) at each of four corners.

3. The modular base element according to claim 2, wherein said modular portion (20) is used to make the envelope of the inflatable and deflatable device, said envelope comprising a plurality of modular portions each of which is made from one said modular portion, each said modular portion joined together along said perimeter to produce said envelope.

4. The modular base element according to claim 3, wherein at least two of said plurality of modular portions (20) have a different area than remaining modular portions (20) of said plurality of modular portions (20).

5. The modular base element according to claim 3, wherein at least one of said plurality of modular portions (82) is incurvated.

6. The modular base element according to claim 3, wherein, at least one of the two flat extensions (16) of at least one modular portion (20) is engaged to at least one internal connection sheet or membrane (30) which is engaged to an opposite side of the envelope of said inflatable device to create at least one internal connection;

said internal connection sheet or membrane (30) maintaining a selected form of the envelope when the envelope is placed under inflation pressure and employed as a reusable formwork support for building construction;

said internal connection sheet or membrane (30) being made of material compatible with material used to make the envelope and the modular base element (10);

the at least one of said internal connection sheet or membrane being endowed with perforations (32) to form passages and to make the overall device lighter.

7. The modular base element according to claim 6, wherein the at least one of the internal connection sheet or membrane produces one or more cavities endowed with a network of additional connections in at least one of said cavities.

8. The modular base element according to claim 7, wherein at least one of the network of additional connections is composed of mesh.

9. The modular base element according to claim 7, wherein at least one of said network of additional connections is composed of interlaced connections.

10. The modular base element according to claim 7, wherein at least one of the network of additional connections is composed of woven connections.

11. The modular base element according to claim 3, wherein at least one of said modular portions of the envelope has a cover mechanism to produce a smooth and unribbed surface, said cover mechanism used as a support for the application of construction material.

12. The modular base element according to claim 3, wherein at least one of the modular portions has a recess to which edges are engaged, an additional structure which can be either an inflatable device or a prefabricated device.

* * * * *